United States Patent [19]

Isola

[11] Patent Number: 4,875,245

[45] Date of Patent: Oct. 24, 1989

[54] BED CLOTHES

[75] Inventor: Richard A. Isola, Bloomfield Hills, Mich.

[73] Assignee: Habitation, Bloomfield Hills, Mich.

[21] Appl. No.: 223,685

[22] Filed: Jul. 25, 1988

Related U.S. Application Data

[63] Continuation of Ser. No. 524,116, Aug. 18, 1983, abandoned, which is a continuation of Ser. No. 218,064, Dec. 19, 1980, abandoned.

[51] Int. Cl.[4] ..... A47G 9/02

[52] U.S. Cl. ..... 5/482; 5/490; D6/597; D6/599

[58] Field of Search ..... 5/482, 490, 495–502; D6/595, 596–603

[56] References Cited

U.S. PATENT DOCUMENTS

| | | | |
|---|---|---|---|
| D. 39,978 | 5/1909 | Whitman | D6/268 |
| D. 72,265 | 3/1927 | Kemp | D6/259 |
| D. 167,338 | 7/1952 | Dorr | D6/264 |
| D. 260,593 | 9/1981 | Dolinar et al. | D6/258 |
| 271,461 | 1/1883 | Holland | 5/482 |
| 3,613,133 | 10/1971 | Isola et al. | D6/259 |

FOREIGN PATENT DOCUMENTS

| | | | |
|---|---|---|---|
| 1166345 | 11/1958 | France | 5/482 |
| 301085 | 6/1964 | Netherlands | 5/482 |

OTHER PUBLICATIONS

"The Washington Star", Sunday Magazine Section 6/25/1967, Left Side of p. 9.

*Primary Examiner*—Alexander Grosz
*Attorney, Agent, or Firm*—Harness, Dickey, Pierce

[57] ABSTRACT

Disclosed herein are bed clothes having first and second ends, sides, sections or areas, with means on the first section or area depicting a first article, object, graphic design, character, scenic background or the like, and means on the second section or area depicting a second article, object, pattern, character, etc., whereby when the bed clothes are placed upon a bed or similar area of repose, with said one section or area arranged adjacent the head position of the bed and associated bed clothes covering the second section or area thereof, the visual impression is given that the bed clothes has solely the first article, object or design depicted thereon, and when said bed clothes are reversed or turned end for end such that the second section or area thereof is arranged adjacent the head position of the bed and said associated bed clothes covering said first section or area thereof, the visual impression is given that the bed clothes has solely the second article, object, pattern, graphic design, etc., depicted thereon.

29 Claims, 5 Drawing Sheets

26'''
134
126
116
16'''
30'''
104
18'''
28'''
20'''
130
128
122
124
106
140

10'''
118
108
112
100
120
116
112
114
110
14'''
144
140
12'''
102
26'''
18'''
116
134
100
116
108
14'''

140
144
102
18'''
144
28''''
108
132
104

16'''
106
142
140
104
108
16'''
140
30'''
106
20'''
18'''
144
26'''
28'''

BED CLOTHES

This is a continuation of U.S. patent application Ser. No. 524,116, filed Aug. 18, 1983, entitled BED CLOTHES, now abandoned, which is a continuation application of U.S. Ser. No. 218,064, filed Dec. 19, 1980 now abandoned.

BACKGROUND OF THE INVENTION

This invention, in general terms, relates to bed clothes elements, particularly sheets and pillowcases, but not excluding, blankets, bedspreads, sleeping bags and the like which are commonly used for purposes of comfort and appearance on beds, couches and similar articles of furniture or areas of repose. More particularly, the present invention relates to bed clothes of the above-described type which illustrate or depict different patterns, articles, objects, graphics or other designs, and the like on different portions thereof and which are designed to be selectively positioned or oriented upon the associated bed to give the visual impression that the bed is provided with either a first set of bed clothes elements depicting a first pattern, article, object, design, etc., thereon or a second set of bed clothes elements depicting a second design, object, article, etc., thereon.

More specifically, and as will hereinafter be described in detail, the present invention is directed toward bed clothes elements, such as sheets and pillowcases, wherein the first and second opposite ends of the sheets are depicted with first and second designs, articles, objects, etc., which designs, articles, etc., may be entirely different from one another or may be related or similar to one another. When the bed clothes elements are placed upon the associated bed, with the first end portions thereof adjacent the head of the bed, and associated bed clothes elements, i.e., blankets or the like, covering the second end portions thereof which are arranged adjacent the foot of the bed, the visual impression is given that the entire bed clothes elements depict solely the first article, object, design, or graphic effect, etc. Conversely, when the bed clothes elements are reversed or turned end for end upon the bed, with the associated blanket, etc., again arranged over the foot end of the bed, the bed clothes elements appear to depict the second design, article, object, or graphic effect, etc.

The particular article, object, pattern, etc., may take any one one of a variety of different forms, ranging from merely plain colors to designs, such as small or large patterns, including single or plural graphics and graphic effects, i.e., single or multiple patterns at each end, as well as realistic or cartoon-like characters, creatures, and animated characters. In accordance with one of the features of the present invention, the pillowcase elements may have the first and second sides thereof printed such that one of the sides depicts the same or an article, graphic, design, pattern, or object related to or co-ordinating with the graphic, design, object, article, etc., depicted on one end of associated sheet elements, and the opposite side of the pillowcase depicting the same or an article, design, pattern, or object related to the object, article, pattern, etc., provided on the opposite end of the associated sheet elements, whereby the pillowcase may merely be turned over to have one side or the other correspond with one end or the other of the associated bed clothes element. In accordance with another feature of the present invention, the bed clothes elements, may have means depicted thereon providing a composite pictorial illustration, whereby portions of an object, article, etc., are depicted on different elements and when the elements are operatively positioned with respect to each other, a complete composite of the object, article, etc., is depicted. For example, in the case of a character (cartoon-like or otherwise), the pillowcase may be depict the face or faces of the character thereon, while the body or other portion of the character is depicted on the associated sheets, whereby when the pillow assumes its normal position at the head of the bed, the head of the character appears to be properly positioned upon the body of the character to provide the desired composite pictorial illustration of the character. Where two different characters are provided at opposite ends of the sheets, the pillowcase may have heads corresponding to the two characters on the opposite sides thereof, whereby the pillowcase may be turned over so that the appropriate head may either correspond to or contrast with the body of the character, article, etc., on the respective end portions of the sheets. It is also contemplated that the composite pictorial illustration mentioned above may be animated and embody changes in attire, such as changes between daytime attire and sleeping attire, such as is shown in U.S. Pat. No. 3,613,133. Also, such changes are not limited to characters and/or animals, since the same type of co-ordination and/or co-operation can be achieved with graphic designs, scenic backgrounds, objects, etc., with or without characters, as will hereinafter be described in detail.

SUMMARY OF THE INVENTION

This invention relates generally to improvements in bed clothes, and more particularly, to bed clothes which are adapted to be printed or otherwise depict different articles, objects, patterns or designs on different sections, areas or portions thereof.

It is accordingly a general object of the present invention to provide a new and improved set of bed clothes for use on beds, couches and related applications.

It is a more particular object of the present invention to provide a new and improved set of bed clothes which when used in one position are intended to depict a first object, design, pattern, article or the like, and when used in a second position, are intended to show or depict a second article, object, character, design, etc.

It is yet a more particular object of the present invention to provide a new and improved set of bed clothes of the above-described character, wherein the bed clothes elements are adapted to be reversed or turned end for end to depict different objects, articles, patterns, etc.

It is a related object of the present invention to provide a new and improved set of bed clothes of the above-described character, wherein one portion of the bed clothes elements are relatively plain, i.e., unprinted, and another portion thereof, i.e., the opposite end of the bed clothes elements, are provided with a pattern or are printed with an article, object, character, etc.

It is a more specific object of the present invention to provide a new and improved set of bed clothes elements, as above described, wherein the opposite ends of the bed clothes elements are depicted with two different designs, characters, objects, articles, etc.

It is a related object of the present invention to provide a set of bed clothes of the above character which includes pillowcase(s) or coverings having first and second sides, the first side of which has means thereon corresponding to the pattern, object, article, defined on one portion of the associated bed clothes elements and the second side of which has means thereon corresponding to the article, object, pattern depicted on the other portion of the associated bed clothes elements.

It is yet another object of the present invention to provide a set of bed clothes of the above-described type, wherein the opposite ends of the bed clothes elements are depicted with different type characters or with characters of the same type which are dressed in different degrees of attire.

It is a more specific object of the present invention to provide a new and improved set of bed clothes elements, as above described, wherein the different degrees of attire on the characters consists of sleeping attire and daytime attire.

It is yet another object of the present invention to provide a new and improved set of bed clothes elements wherein at least one end of the bed clothes elements depict a scenic background or portion thereof.

It is a further object of the present invention to provide a set of bed clothes, as above described, wherein one of the patterns or articles, objects, etc., depicted on the first portion of the bed clothes elements includes at least in part, a real or cartoon-like character.

It is a related object of the present invention to provide a set of bed clothes, as above described, wherein the character or some other article, object, etc., is animated or appears to change position or condition.

It is still another object of the present invention to provide a new and improved set of bed clothes including sheets and pillowcases, with the sheet(s) being provided with means depicting a life-like creature arranged in a position of repose on the bed and the pillowcase being provided with means defining the head of the creature depicted on the sheet(s), whereby when the pillowcase is operatively mounted upon the bed, the head of the creature, as depicted upon the pillowcase, is arranged in a life-like relation with respect to the body of the creature depicted upon the sheet(s).

Other objects and advantages of the present invention will become apparent from the following detailed description taken in conjunction with the accompanying drawings.

DETAILED DESCRIPTION OF THE PREFERRED EMBODIMENTS

Figure 1:
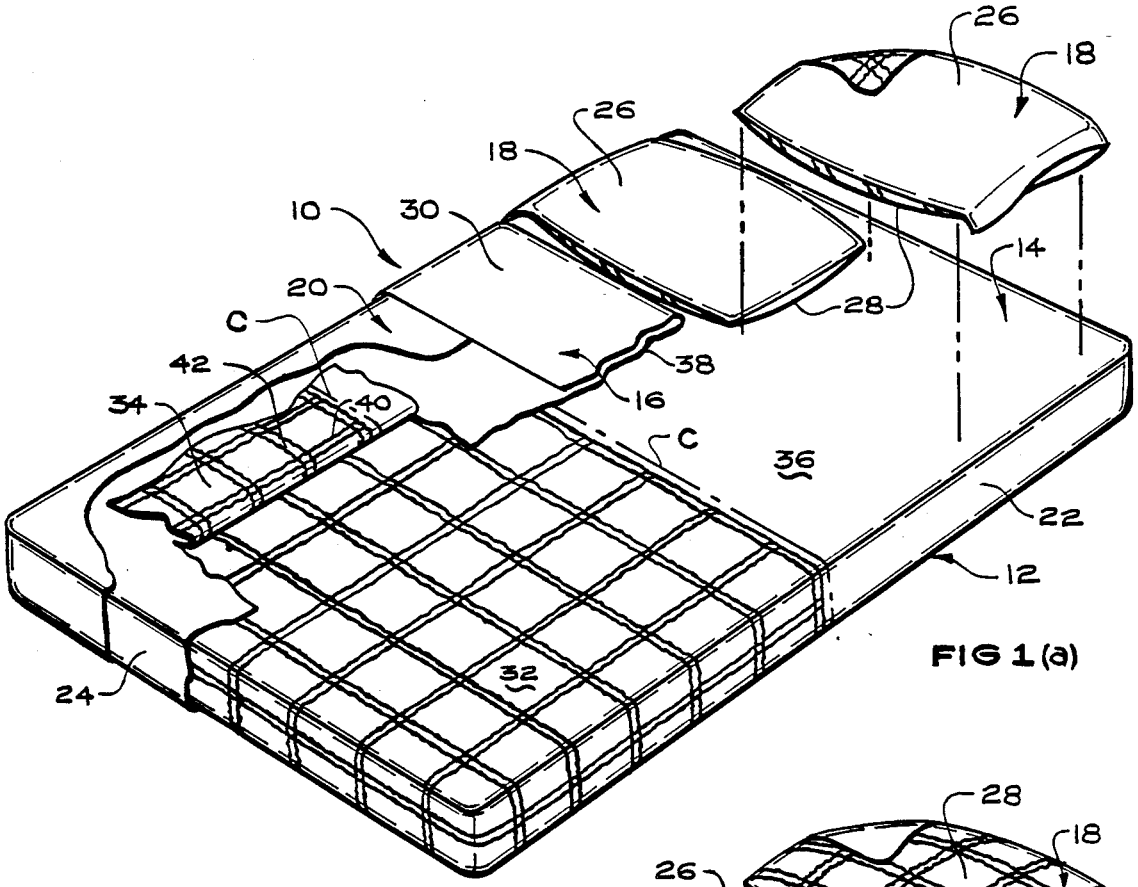
FIG. 1*a* is an elevated perspective view, partially broken away, of a mattress or similar portion of a bed having one embodiment of the bed clothes of the present invention in operative association therewith.
FIG. 1*b* is an elevated perspective view similar to FIG. 1*a* having the bed clothes elements on the bed reversed end for end and having the pillows and associated pillowcases turned over from their respective positions shown in FIG. 1*a;*
Figure 1:
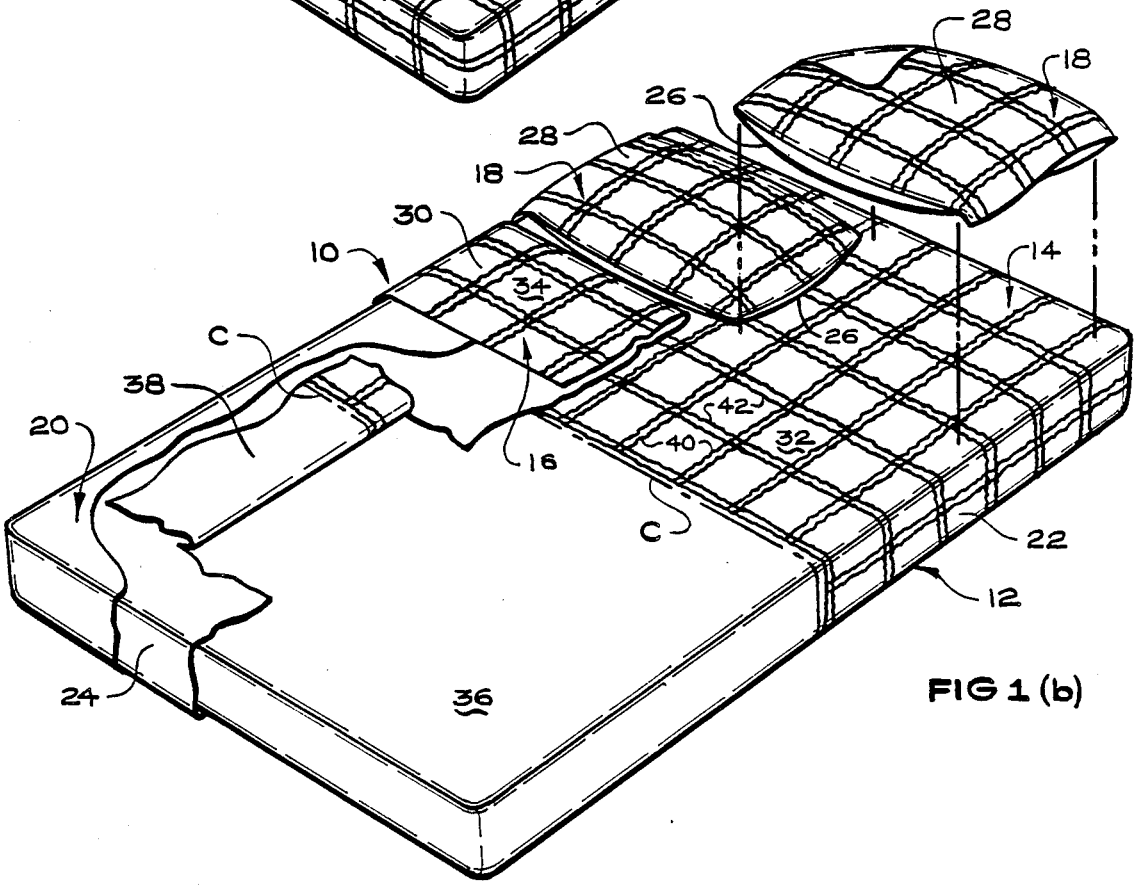

For purposes of understanding the scope of the present invention, the following terms are used herein:

Printed—Any manner of providing means on a bed clothes element whereby the element depicts an article, pattern, design, graphic representation, person, creature, character, animal, scene, etc., as appearing on, near, or adjacent the plane of the element including and without limitation, weaving, sewing, or embroidering, or by printing or stamping as by an engraved plate or lithograph, photographic process, silk screen, or otherwise providing an impression on the bed clothes elements through the use of roller printing, dye transferred by pressure, spraying or otherwise from a plate, roller or the like.

Bed—Any article for one or more to sleep on or take rest on or in, or any thing or place for sleeping, resting or reclining, including mattresses, sleeping bags, couches, etc., and including a head section wherein the one sleeping, resting or the like may position its head, shoulders and other portions of the upper part of its anatomy, and a foot section wherein the one resting, reclining, etc., may position its feet, legs or other portions of the lower part of its anatomy. (It is contemplated that a sleeping bag could use either end as the head end or the foot end.)

Animated—Any means by which a person, creature, character, object, animal, scene or other article appears to have moved, changed position, changes clothing or otherwise undergoes a realistic or life-like transition of condition, position or physical appearance.

Degree of attire—Any amount of or extent of dress, array or adornment of equipment, clothing, apparel or other garments which a person, animal, creature, character or article may wear or be normally covered or otherwise provided with or use.

Composite pictorial illustration—An illustration of an article, object, creature, character, pattern, graphic design, etc., made up of more than one partial illustration which appear on separate or individual bed clothes elements or on spaced apart portions of the same elements, and when arranged in a predetermined manner or orientation, together depict the object, character, pattern, etc., in a completed or substantially completed form.

Bed clothes element—Any type and size of sheets, pillowcases, blankets, quilts, bed spreads, sleeping bags, etc., either fitted or non-fitted for a particular bed, as defined above.

Pillow—Anything used to support the head or other part of the anatomy of a person, article, object, character, etc., reposing, reciling, sleeping or otherwise resting, such as a cushion or other soft, resilient fabric enclosure filled with feathers, down, hair, sponge rubber or other relatively deformable or non-deformable or compliant material.

Sleeping attire—Any degree of attire commonly worn by a person, animal, character or the like when sleeping, resting, reclining or otherwise reposing, such as pajamas, nightrobes, dressing gowns or other costumes, and not excluding the entire absence of any attire whatsoever, as may be considered to be "sleeping attire".

Daytime attire—Any degree of attire commonly worn by a person, animal, object, character or the like other than sleeping attire, as defined above.

Graphics—Any type of design or pattern, including stripes, repetitive patterns, and including relatively small patterns which may be printed in a repeated fashion upon a bed clothes element, or a single object printed on a bed clothes element.

Referring now in detail to the drawings and in particular to FIGS. 1*a* and 1*b*, a set of bed clothes, generally designated by the numeral 10, in accordance with one preferred embodiment of the present invention, is shown in operative association with a conventional bed, mattress or the like 12, and comprises a lower bed clothes element 14, an upper bed clothes element 16 and a pair of pillowcase elements 18 adapted to be surmounted on or receive a pair of suitable pillows or the like (not shown). The bed clothes elements 14 and 16 may consist of any of the items defined above, but preferably comprise lower and upper bed sheets of the type well known in the art. The bed clothes elements 14, 16 are shown in operative association with a conventional blanket or similar cover-like element, generally designated by the numeral 20, which is adapted to be placed over the upper bed clothes element 16 adjacent the foot of the bed 12, as shown in FIGS. 1*a* and 1*b*. The lower element 14 may be either fitted or non-fitted with respect to the associated bed, mattress or the like 12, and for purposes of illustration, is shown as being of a fitted-type and comprising downwardly extending side portions 22 which are retained in close proximate relation with the sides of the associated mattress or bed 12 by conventional elastomeric means which is arranged adjacent the underside of the bed or mattress 12 when the lower bed clothes element 14 is disposed thereon, as is well known in the art. Similarly, the upper bed clothes element 16 may be either fitted or non-fitted, but for purposes of illustration, is shown as being non-fitted and having side portions 24 which depend downwardly along the side edges of the mattress or bed 12 which may, if desired, have marginal edge portions thereof "tucked" under the same, in the manner well known in the art.

As is conventional, the pillowcase elements or pillowcases 18 comprise upper and lower sides 26 and 28 and are adapted to be juxtapositioned along with their associated pillows adjacent the head of the bed 12 for purposes of supporting the head or other part of the anatomy of a person reclining, sleeping or otherwise reposing thereon, As is conventional in "making" the bed 12, the upper bed clothes element 16 has the portion thereof adjacent the head of the bed folded back upon itself, or if desired, over an adjacent portion of the element 20, as indicated at 30.

In accordance with the principles of the present invention, the set of bed clothes 10 is printed in a manner such that when the bed clothes elements 14, 16 are disposed in one position upon the bed 12, a first visual impression is given, and when the bed clothes element 14, 16 are inverted or changed end for end, a second visual impression is given. More particularly, the bed clothes elements 14, 16 are printed such that first areas or portions thereof, preferably the end portions 32 and 34 thereof, give a first visual impression, while second areas or portions thereof, preferably end portions 36 and 38 thereof, are printed to give a second visual impression. In the specific embodiment shown in FIGS. 1*a* and 1*b*, the portions 32, 34 and 36, 38 are located adjacent the opposite ends of the major (longitudinal) axis of the elements 14, 16 and respectively comprise approximately one-half of the area of the bed clothes elements 14, 16. As illustrated, the end portions 32, 34 are disposed in FIG. 1*a* adjacent the foot of the bed 12, while the end portions 36, 38 are disposed adjacent the foot of the bed 12, with the end portions 32, 34 and 36, 38 confronting one another along and lying on the opposite sides of imaginary lines designated by the letter C which extend laterally or transversely of the bed 12 from one side thereof to the other. In the embodiment shown in FIGS. 1*a* and 1*b*, the end portions 32, 34 are printed with a design, pattern, graphic or other article or object, herein shown by way of example as consisting of a series of longitudinal and transverse lines or stripes 40, 42 forming a plaid pattern, while the end portions 36, 38 are "unprinted", i.e., are a plain color (white or otherwise) and hence, give the visual impression of being unpatterned.

In accordance with the present invention, the upper and lower sides 26, 28, respectively, of the pillowcases 18 are adapted to correlate with the end portions 32, 34 and 36, 38 of the upper and lower bed clothes elements 16, 14 such that the upper sides 26 of the pillowcases 18 cooperate with end portions 32, 34 to give one visual impression, while the undersides 28 of the pillowcases 18 cooperates with the end portions 36, 38 to give a second visual impression. By way of example, the correlation between the sides 26, 28 of the pillowcases 18 and the end portions 32, 34 and 36, 38 is that the sides 26, 28 are of the same appearance, i.e., are patterned and unpatterned, respectively, although it is to be appreciated that such correlation can be in the form of contrasting, complementary or other related or dissimilar appearances without departing from the present invention.

With the aforesaid arrangement, with the bed clothes 14, 16, 18 disposed in their respective positions shown in FIG. 1*a*, the end portions 32, 34 of the bed clothes elements 14, 16 are arranged adjacent the head of the bed, and the pillowcases 18 are arranged such that the sides 26 thereof face upwardly, whereby to give the visual impression that the entire bed clothes elements 14, 16, 18 are printed with the pattern, article, object, design or the like depicted on the end portions 32, 34 of the bed clothes elements 14, 16, and on the side 26 of the pillowcases 18, i.e., printed with the plaid pattern made up of the stripes 40, 42. At such time as it is desired to change the visual impression given by the bed clothes elements 14, 16, 18 from that provided with said elements arranged in the manner shown in FIG. 1*a* to the visual impression that all of the bed clothes elements 14, 16, 18 are unpatterned, i.e., printed with a plain color, the elements 14, 16 are reversed or changed end for end such that the end portions 36, 38 thereof are disposed adjacent the head of the bed and the end portions 32, 34 thereof are disposed adjacent the foot of the bed. Additionally, the pillowcases 18 are inverted or turned over such that the sides 28 thereof, which are printed to give the same visual impression, pattern, or the like as the end portions 36, 38 of the elements 14, 16, face upwardly. In either of the arrangements shown in FIGS. 1*a* or 1*b*, the covering element 20 covers the end portions 32, 36 or 34, 36 of the elements 14, 16 as the case may be, located adjacent the foot of the bed, and hence, to a typical observer of the bed 12 in either the condition shown in FIG. 1*a* or the condition shown in FIG. 1*b*, the bed clothes elements 14, 16 and 18 appear to be of a printed design or pattern in the case of FIG. 1*a*, or of an unprinted or plain design in the case of the arrangement shown in FIG. 1*b*, and thus, the single set of bed clothes can give either of two entirely different visual appearances without apprising the observer that it is the same set of elements providing such appearances. It is to be noted that more than two different appearances can be achieved from the single set of bed clothes elements 14, 16 where only one or the other thereof are turned end for end and/or where one or the other of the pillowcase elements 18 are turned over.

For purposes of conciseness of description, the subsequently described embodiments of the present invention have the common elements, or portions, or areas thereof designated by like reference numerals with prime (′), (″), (‴) or (⁗) suffixes.

Figure 2A:
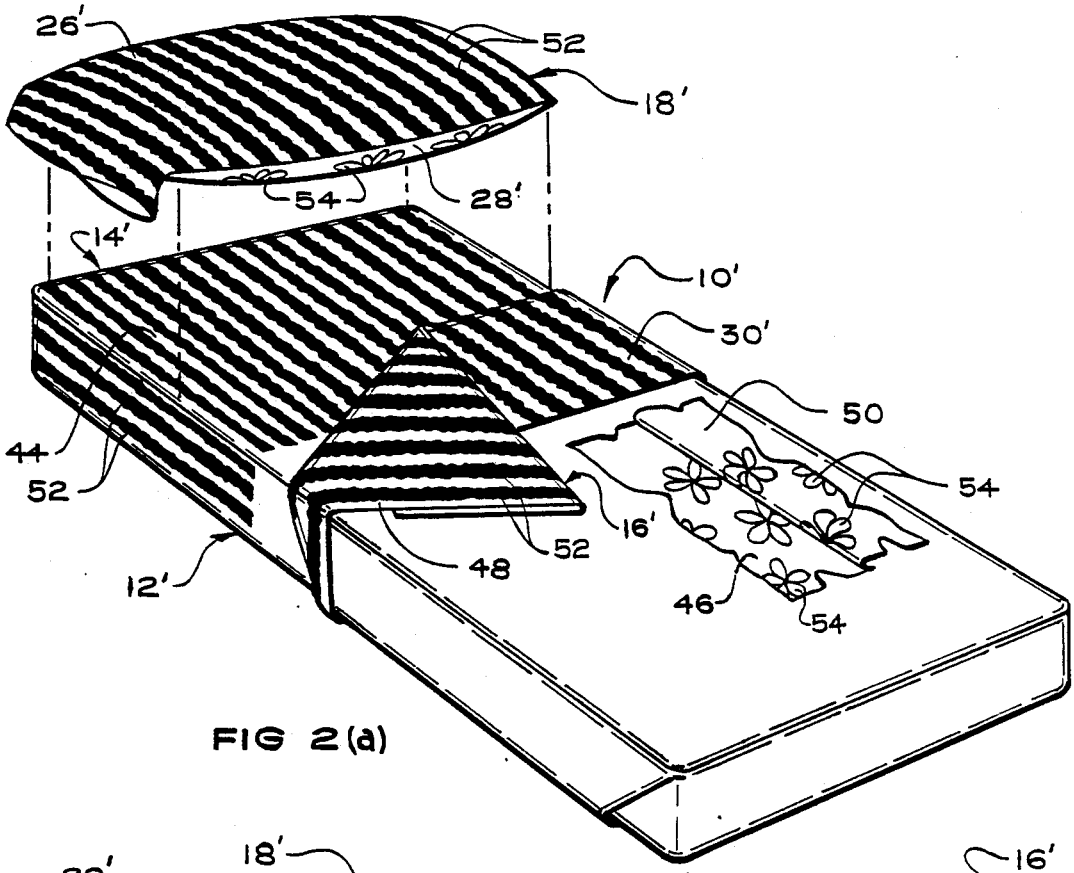
FIG. 2*a* is an elevated perspective view, similar to FIG. 1*a*, of an alternate embodiment of the bed clothes of the present invention.
Figure 2B:
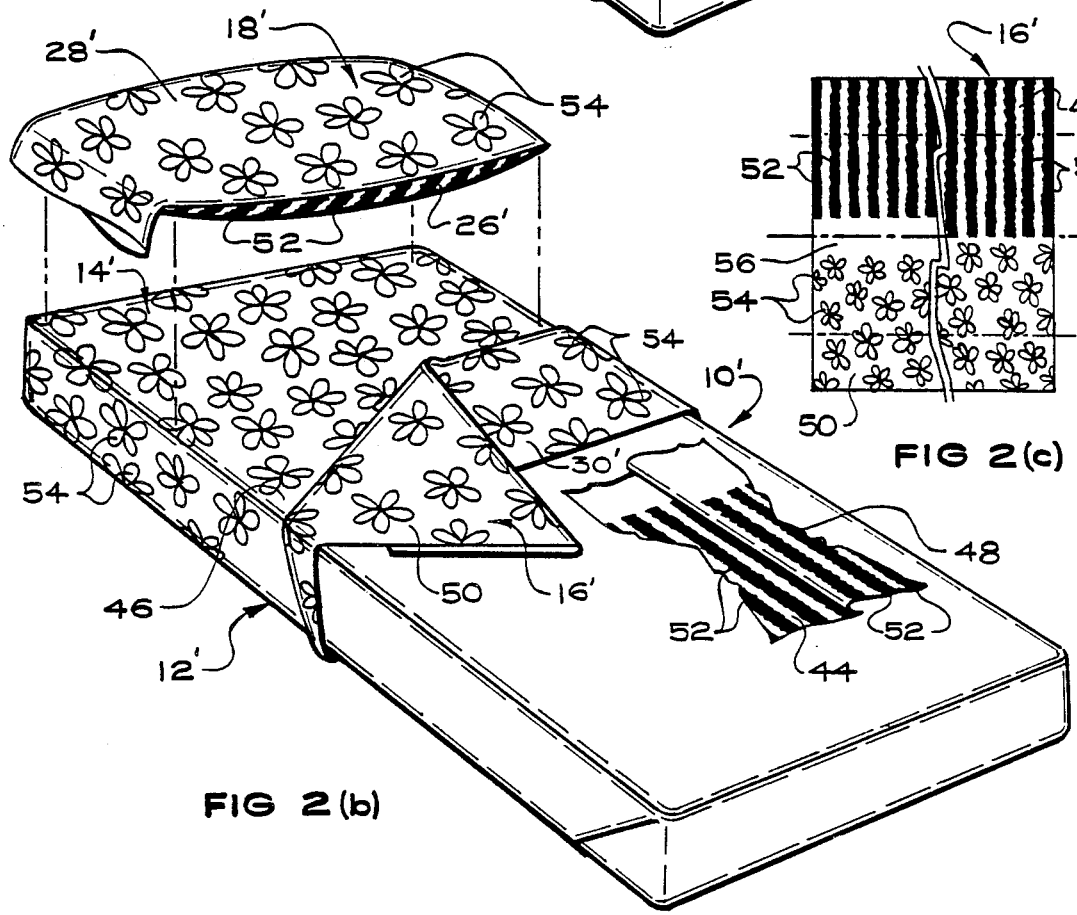
FIG. 2*b* is a view similar to FIG. 2*a* with the bed clothes on the bed turned end for end from the position shown therein and with the pillow and associated pillowcase turned over from the position shown in FIG. 2*a;*

Referring now to another embodiment of the present invention, as shown in FIGS. 2*a* and 2*b*, a bed 12′ is provided with bed clothes elements 10′ comprising upper and lower bed sheets 14′, 16′, respectively, and a pillowcase 18′. The sheets 14′, 16′ have opposed end portions 44, 46 and 48, 50, respectively, which are provided with two different printed designs, one of which designs is provided on each of the opposing sides 26′ and 28′ of the pillowcase 18′. In particular, the end portions 44 and 48 of the sheets 14′, 16′ are provided with the same striped pattern consisting of longitudinally extending stripes 52, as is the side 26′ of the pillowcase 18′. The opposite end portions 46 and 50 of the sheets 14′, 16′ are provided with the same pattern but one which is different from that on the end portions 44, 46, which pattern, by way of example, is shown as comprising a plurality of flower-like designs, generally designated by the numeral 54. The side 28′ of the pillowcase 18′ is likewise provided with the same pattern of flower-like designs 54, as illustrated.

As in the case with the first described embodiment of the present invention, the bed clothes elements 10′ may be selectively alternately positioned upon the bed 12′ in either of the respective positions shown in FIGS. 2*a* or 2*b*, and in either of the two positions, when the bed 12′ is viewed, all of the elements 14′, 16′ and 18′ appear to be printed with either the stripes 52 or alternatively, with the pattern of flower-like designs 54. That is, when the elements 14′, 16′ and 18′ are arranged in the manner shown in FIG. 2*a* such that the end portions 44 and 48 of the sheets 14′, 16′ are arranged adjacent the head of the bed 12′ and the associated pillow is oriented such that the side 26′ of the pillowcase 18′ is facing upwardly, the entire set of bed clothes elements 10′ gives the visual appearance of being printed solely with the pattern of stripes 52. Conversely, when the sheets 14′ and 16′ are reversed end for end from the position shown in FIG. 2*a* to the position shown in FIG. 2*b*, and the pillowcase 18′ and associated pillow are turned over from the position shown in FIG. 2*a* to the position shown in FIG. 2*b*, the entire set of bed clothes elements 10′ gives the visual appearance of being printed solely with the pattern of flowers 54.

Figure 2C:
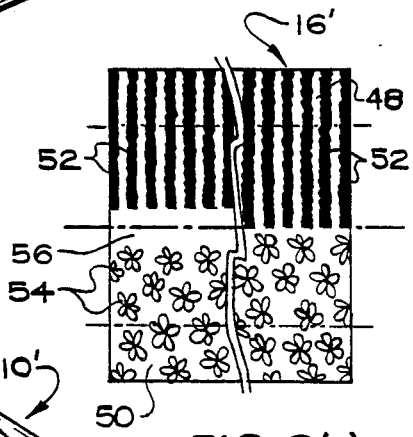
FIG. 2*c* is a plan view, partially broken away, of one of the bed clothes elements shown in FIGS. 2*a* and 2*b;*

It is to be noted that the printed designs on the end portions 44, 46 and 48, 50 of the sheets 14′ and 16′ may have their confronting portions directly juxtapositioned, such as is shown in the righthand portion of the plan view of the sheet 16′ shown in FIG. 2*c*, or instead, may have the confronting portions thereof spaced somewhat apart, such as is indicated at 56 in the lefthand portion of FIG. 2*c*, without departing from the scope or intent of the present invention, the particular magnitude of spacing between the two patterns on each of the sheets 14′, 16′ preferably being such that the pattern which is normally adjacent the foot of the bed will not be exposed when the upper sheet 16′ is disposed in the manner shown at FIGS. 2*a* and 2*b*. It is to be noted that when the two patterns on either the elements 14′ or 16′ are spaced apart, as is shown at 56 in FIG. 2*c*, the space therebetween may be plain (unpatterned) or may have some third pattern depicted.

It is also to be noted that the patterns consisting of the stripes 52 and flower-like designs 54 are merely shown herein for purposes of example, and that the present invention is in no way intended to be limited to these specific patterns or designs, since either of the patterns may take other forms, or may consist of plain colors, as in the embodiment of the present invention shown in FIGS. 1*a* and 1*b*, or either of the patterns may depict various other objects or articles taken from the group of patterns, designs, persons, characters, animals, graphics, scenic backgrounds, games, etc., without departing from the scope of the present invention and as will hereinafter be described in connection with the FIGS. 3*a*, 3*b*, 4*a*–4*d* and 5*a*–5*d*. It is also to be noted that the present invention is not necessarily limited to the bed clothes elements 14′, 16′, 18′ all being simultaneously reversible from end to end or over (as in the case with the pillowcase 18′) since it may be desirable in certain instances to have contrasting patterns exposed at the head of the bed. For example, in the case of the patterns shown in FIGS. 2*a* and 2*b*, it may be desirable to have the lower sheet 14′ and side 26′ of the pillowcase 18′ providing one visual impression, i.e., a striped pattern, with the upper sheet 16′ being inverted to the position shown in FIG. 2*b* such that the flower-like design 54 is shown when the upper edge of the sheet 16' is folded back to the position shown at 30', whereby the flower-like designs 54 will be shown in close proximate relation or association with the stripes 52, whereby to display contrasting or complementary colors, designs, etc.

Figure 3:
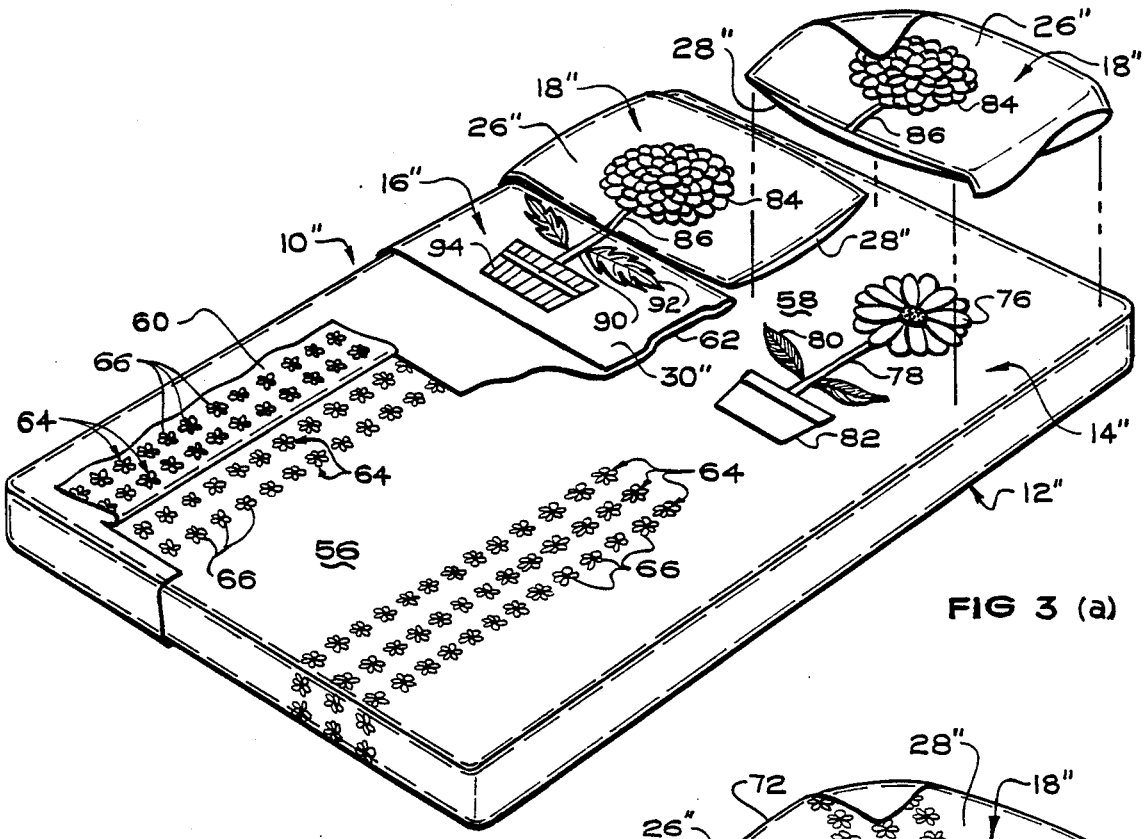
FIG. 3*a* is an elevated perspective view of a mattress or similar portion of a bed having yet another embodiment of the bed clothes of the present invention in operative association therewith.
FIG. 3*b* is a view similar to FIG. 3*a* with the bed clothes elements on the bed turned end for end from the position shown in FIG. 3*a* and with the pillows and associated pillowcases turned over from their respective positions shown in FIG. 3*a;*
Figure 3:
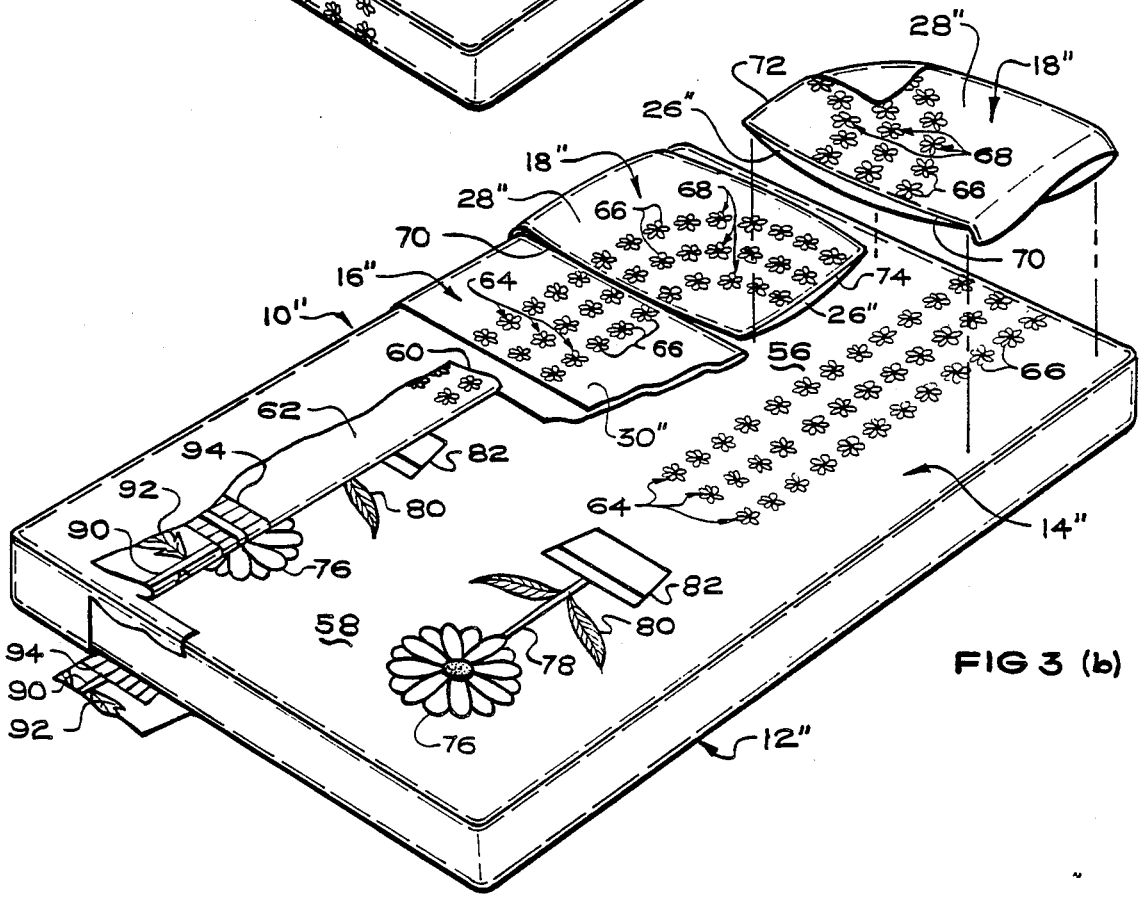

FIGS. 3*a* and 3*b* illustrate still another embodiment of the present invention wherein a bed 12" is provided with bed clothes elements 10" comprising lower and upper bed sheet 14", 16", respectively, and a pair of pillowcases 18". The sheets 14", 16" have opposed end portions 56, 58 and 60, 62 that are respectively provided with two different printed designs, which, in a manner hereinafter to be described, cooperate with designs printed on the sides 26", 28" of pillowcases 18" to give desired visual impressions. In particular, the end portions 56 and 60 of the sheets 14", 16" are provided with a design or pattern which is intended to cooperate with the design or pattern on the sides 26" of the pillowcases 18" in depicting a composite pictorial illustration, as defined above, while the end portions 58 and 62 of the sheets 14", 16" are provided with a design or pattern which is intended to cooperate with the design or pattern on the sides 28" of the pillowcases 18" in depicting a different composite pictorial illustration. More specifically, the end portions 56 and 60 of the sheets 14", 16" are provided with two laterally spaced apart, longitudinally extending sets of three rows or stripes 64 of flower-like designs, generally designated by the numeral 66 that extend from extreme longitudinal ends of the sheets 14", 16" to a position approximately halfway between the opposite longitudinal ends thereof. The sides 28" of the pillowcases 18" are printed or provided with quarter arcs, i.e., 90° arcs, of three rows 68 of the same flower-like designs 66 which curve approximately 90° between a position adjacent the lower edges 70 of the pillowcase sides 28" and the mutually confronting side edges 72, 74 thereof, whereby when the two pillowcases 18" are places side by side in the manner best shown in FIG. 3*b*, the two quarter arcs of flower-like designs 66 form an inverted U configuration, the lowermost leg portions of which are adapted to be pictorially aligned with the rows 64 of flower-like designs 66 printed on both the end portions 56, 60 of the sheets 14" and 16", with such alignment with the upper sheet 16" being particularly illustrated when the end portion 30" is turned or folded back, as seen in FIG. 3*b*. This arrangement results in the rows 64 of designs 66 on the sheets 14" and 16" being pictorially aligned with the rows 68 of designs 64 on the pillowcases 18" so as to provide the pictorial illustration of an arch-type configuration consisting of spaced apart legs formed by the rows 64 of designs 66 and the U-shaped "head" or top formed by the two quarter arcs of rows 68 of designs 66 on the pillowcase sides 28".

The opposite end 58 of the lower sheet 14" is provided with a pattern which is different from the rows 64 of flower-like designs 66 and, by way of example, is provided with a pair of enlarged flower-like designs 76 arranged at the upper ends of generally longitudinally extending stems 78, having leaves 80 and which are "potted" in suitable flower pots or containers 82. The pair of flower designs 76 are spaced laterally apart upon the lower sheet 14" and are arranged generally longitudinally in line with the central portions of the pillowcases 18", as illustrated in FIG. 3*a*, with the flowers 76 being disposed at a position wherein they underly the pillowcases 18" when the same are placed in their normal operative position at the head of the bed 12". The flowers 76, as will hereinafter be described, are intended to cooperate with printed designs on the upper sheet 16" and sides 26" of the pillowcases 18" to provide a composite pictorial illustration, and toward this end, the sides 26" of the pillowcases 18" are printed with flower designs 84 which may be the same or different from the flowers 76 and by way of example, are shown as being of different flower designs and having longitudinally downwardly extending stems 86 which are arranged generally centrally of the pillowcase sides 26" such that when the pillowcases 18" are placed in their normal position upon the bed 12", the stems 86 of the flowers 84 align generally longitudinally with the stems 78 of the flowers 76 on the lower sheets 14" to give the visual impression that the flowers 84 are actually "growing" on the upper ends of the stems 78.

With reference now to the end portion 62 of the upper sheet 16", which is herein printed with a portion of a composite pictorial illustration formed by the flowers 84 on the sides 26" of the pillowcases 18". In particular, the end portion 62 of the upper sheet 16" is printed with a pair of longitudinally extending, laterally spaced apart flower stems 90 having leaves 92 disposed thereon and the opposite ends terminating within two pair of laterally spaced flower pots or containers 94. As will be apparent from viewing FIGS. 3*a* and 3*b*, when the upper edge portion 30" of the upper sheet 16" is folded down in the position shown in FIG. 3*a*, two of the flower pots 94 open upward toward the head of the bed 12" and the stems 90 are pictorially aligned with both the stems 78 on the lower sheet 14" and with the stems 86 on the sides 26" of the pillowcases 18", whereby to provide a composite pictorial illustration, as defined above.

As in the case with the above-described embodiments of the present invention, the bed clothes elements 10" are adapted and intended to be selectively alternately positioned upon the bed 12" in either of the respective positions shown in FIGS. 3*a* and 3*b*, and in either of the two positions, when the bed 12" is viewed, all of the elements 14", 16" and 18" appear to be printed solely with either the composite pictorial illustration of the stripes and arcs of flower-like designs 66 forming, as previously mentioned, an arch-like shape or image, or alternatively, as depicted in FIG. 3*a*, with the composite pictorial illustration of the flowers 76, 84, flower pots 82, 94, etc., depending upon the end-for-end orientation of the sheets 14", 16" and the particular sides of the pillowcases 18" which are facing upwardly.

Figure 4:
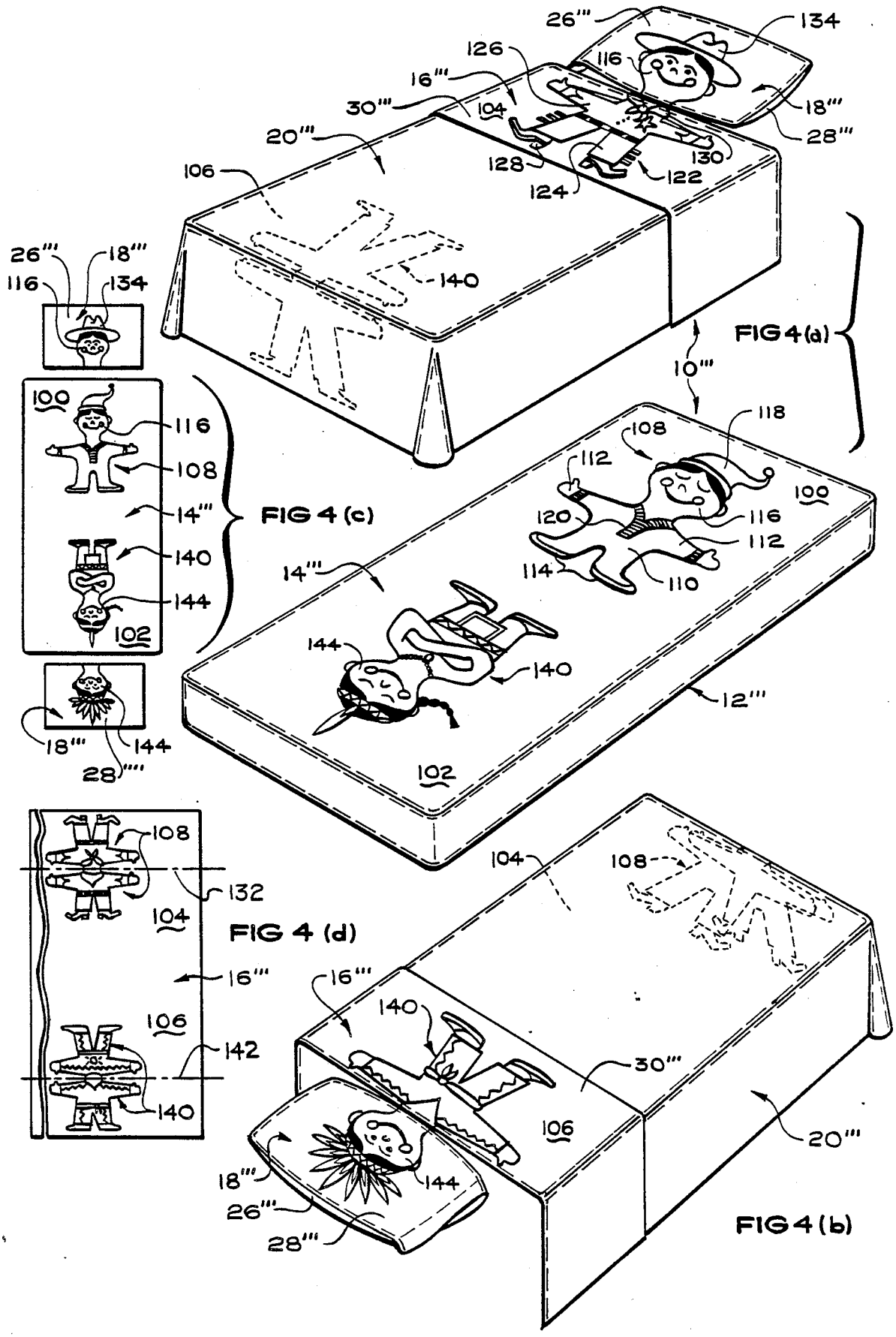
FIG. 4*a* is an exploded assembly view of yet another embodiment of the bed clothes of the present invention, as shown in operative association with the mattress and lower sheet portion of a bed.
FIG. 4*b* is an elevated perspective view of the upper bed clothes element shown in FIG. 4*a*, but which is turned end for end from the position shown in FIG. 4*a*, and with the associated pillow and pillowcase turned over from the position shown in FIG. 4*a;*
FIG. 4*c* is a plan view of the lower bed clothes element shown in FIGS. 4*a* and 4*b*, as shown in operative association with the upper and lower sides of the pillowcase depicted in FIG. 4*a;*
FIG. 4*d* is a plan view of the upper bed clothes element depicted in FIGS. 4*a* and 4*b;*

FIGS. 4*a*–4*d* illustrate yet other embodiments of the present invention wherein the end-for-end reversibility feature of the bed clothes (sheets) and composite pictorial illustration features described in connection with FIGS. 3*a* and 3*b* are applied to cartoon characters, which, by way of example and not limitation, have certain human-like features. In particular, FIGS. 4*a*–4*d* illustrate a set of bed clothes 10''' comprising an upper bed clothes element 16''', a lower bed clothes element 14''' and a pillowcase 18''', all of which are shown in operative association with a blanket or bed spread 20'''. By way of example, the lower bed clothes element or sheet 14''' is shown in FIG. 4*a* as being of the "fitted" type and is operatively disposed upon a mattress or bed 12''', with the element 14''' having longitudinally opposed end portions 100 and 102 which are respectively shown as being oriented adjacent the head and foot ends of the bed 12''' in FIG. 4*a*. Likewise, the upper bed clothes element 16''' is shown as comprising longitudinally opposed end portions 104 and 106 which are respectively shown as being oriented adjacent the head and foot ends of the bed 12''' in FIG. 4*a*, and which, along with the lower bed clothes element 14''' is adapted to be inverted or turned end for end upon the bed 12''' from the position shown in FIG. 4*a* to the position shown in FIG. 4*b*. For purpose of illustration, the upper bed clothes element 16''' is shown as being of the non-fitted type. As hereinbefore described, the pillowcase 18''' comprises opposed sides 26''' and 28''' which are printed or otherwise provided with two different patterns or designs that are adapted to cooperate or coordinate with designs or patterns on the end portions 100, 102 and 104, 106 of the bed clothes elements 14''' and 16''', depending on the end-for-end orientation thereof upon the bed 12''', and by way of example and illustration and not by way of limitation, the pattern or design on the elements 14''', 16''' and 18''' shown in FIGS. 4*a*–4*d* comprises composite pictorial illustrations of two different characters.

Referring now specifically to the characters depicted on the bed clothes elements 14''', 16''' and 18''' and first to a character generally designated by the numeral 108 that is illustrated on the end portions 100 and 104 and side 26''' of the pillowcase 18'''. The character 108 comprises human-like features including a torso 110, arms 112, legs 114 and head 116 and is shown as wearing sleeping attire in the form of a nightcap 118 and pajamas 120. Preferably, although not necessarily, the character 108 is depicted as being generally child-size so that the longitudinal length (character's height) is slightly less than half the length of the lower bed clothes element 14''', with the character 108 generally assuming the position shown in FIG. 4*a* of a person resting, reclining, or otherwise reposing upon the bed 12'''.

Referring now to the upper bed clothes element (sheet) 16''' and particularly to the end portion 104 thereof, as best seen in FIG. 4*d*, the end portion 104 of the sheet 16''' is printed with a pattern which comprises front and rear views of the character 108 wearing street attire, generally designated 122. More specifically, the street attire 122 for the character 108, by way of example, comprises pants 124, shirt 126, boots 128 and neck bandana 130, all of which are depicted as being of a western or "cowboy" motif. As best seen in FIG. 4*d*, the front and rear views of the character 108 are printed on the end portion 104 without the head 116 and in "neck" to "neck" relation with the mutually confronting portions thereof extending generally longitudinally of the sheet 16''' in opposite directions from the fold line 132 along which the end potion 30''' is folded back toward the foot of the bed 12''', as seen in FIG. 4*a*. The front and rear views of the character 108 are arranged generally along the longitudinal centerline (but could be located laterally from centerline) of the sheet 16''' so that when the end portion 30''' thereof is folded back along the line 132, the front and rear views of the character 108 overlie one another and also overlie the view of the character 108 printed on the lower sheet 14''' when the sheet 16''' is disposed in its normal operative position on the bed 12'''. Preferably, although not necessarily, the front view of the character 108 is printed on the end portion 30''' of the sheet 16''', while the rear view thereof is printed in the illustrated inverted orientation on the opposite side of the fold like 132 and hence, is disposed on the underside of the sheet 16''' when the same is placed in its normal position on the bed 12'''.

The pillowcase 18''' has its side 26''' printed with the head 116 of the character 108 and is shown as having a daytime attire "cowboy" hat 134, whereby when the pillowcase 18''' and its associated pillow are properly positioned at the head of the bed 12''', a composite pictorial illustration is achieved by virtue of the fact that the head 116 of the character 108, as depicted on the side 26''' of the pillowcase 18''', is pictorially aligned with the body of the character 108 shown on the portion 30''' of the upper bed clothes element 16'''. Moreover, when the upper bed clothes element 16''' is folded back from its position shown in FIG. 4*a* so as to expose the character 108 on the end portion 100 of the lower bed clothes element 14''', the head 116 on the pillowcase 18''' is pictorially aligned with the character 108 on the lower bed clothes element 14''' to provide a second composite pictorial illustration. As described in U.S. Pat. No. 3,613,133, the above-described arrangement results in the character 108 undergoing a transition from wearing street attire to wearing sleeping attire. That is, the character 108 will appear to become undressed or have its street attire removed, thereby leaving the character 108 in its sleeping attire. This undressing sensation is further achieved by virtue of the fact that the rear side of the character 108 is printed on the underside of the upper bed clothes element 16''' so that when the element 16''' is folded back, as would typically occur when preparing the bed 12''' for use or sleep, the illusion is given that the character 108 is actually undressing or otherwise changing its degree of attire.

In accordance with the present invention, the opposite end portions 102 and 106 of the bed clothes elements 14''' and 16''' are printed with a character which is different from the character 108 and which has a portion thereof depicted on the side 28''' of the pillowcase 18''' so as to provide a composite pictorial illustration which is different from that immediately hereinabove described. More particularly, the end portion 106 of the upper bed clothes element 16''' is printed with the front and rear sides or views of a character 140 which is depicted in a native costume or attire with the front and rear views of the character 140 appearing without heads and in "neck-to-neck" relation on the opposite sides of the fold line 142. Similarly, the end portion 102 of the lower bed clothes element 14''' is printed with the same character 140 in the same or in a different native costume which, by way of example, is of a different degree of attire from that shown on the upper bed clothes elements 16'''. The side 28''' of the pillowcase 18''' is printed with the head 144 of the character 140 so that a composite pictorial illustration is achieved when the pillowcase 18''' and upper and lower bed clothes elements 16''' and 14''' are oriented in the relationship hereinabove described in connection with the character 108. It is to be noted, however, that the character 140, along with undergoing a change of attire when viewed on the upper and lower bed clothes elements 16''' and 14''', is animated to the extent that its arms and legs make the transition from extending outwardly to being folded and moved together, respectively. It will be appreciated that the above-described changes of attire and animation are merely exemplary and the other changes in attire and/or animation of the illustrated or other characters may be readily achieved.

As hereinabove described, the bed clothes elements 14''' and 16''' are intended to be selectively end-for-end positioned upon the bed 12''' so that either the character 108 or the character 140 is arranged adjacent the head of the bed, with the correlative side of the pillowcase 18''' facing upwardly so that the appropriate head 116 or 144 on the sides 26''' and 28''' thereof is pictorially aligned with the bodies of the characters 108, 140. It is to be noted that for certain cartoon or animated effects, a totally unrelated head and body relationship can be achieved between the bed clothes elements 14''' and 16''' and the pillowcase 18''', such as, for example, the head of an animal could be associated with a human-like body, or vice versa, so that with the proper design, the head or any other object or pattern on either side of the pillowcase could be operatively associated with the character or other design, pattern, object or article at either end of either or both of the associated bed clothes elements 14''' and 16'''.

FIGS. 5a–5d illustrate yet another alternative embodiment of the present invention wherein a common or related vocation, advocation, hobby or theme is depicted at different portions of the bed clothes elements, whereby when the bed clothes are oriented in a first position on the associated bed, a first theme, vocation, hobby or advocation is depicted, and when the same bed clothes elements are oriented at a second position on the associated bed, a second theme, vocation, hobby, advocation, etc., is depicted. By way of example, and in no way by way of limitation, bed clothes elements 14'''', 16'''' and 18'''' in FIGS. 5a–5d depict a common theme, namely, hobbies, and also solely by way of example, the opposite ends of the elements 14'''' and 16'''' and the opposite sides of the pillowcase 18'''' depict hobbies that are different, namely, railroading and aircraft or flying.

More specifically, the lower bed clothes element 14'''' is shown as comprising opposed end portions 150 and 152, and the end portion 150 is shown as depicting the front view of a railroad engine, particularly, a diesel engine 154, traveling along railroad tracks 156 on a roadbed 158, with the roadbed 158 being illustrated in conjunction with a scenic background 160 which, by way of example, comprises hill or mountain areas 162 and a clouded background or sky area 164. The opposite end 152 of the lower bed clothes element 14'''' is depicted with a group of related items all pertaining to a common theme, namely, airplanes or flying aircraft, and specifically, a side view and a top view of a bi-plane type aircraft 166 is shown along with two side views of the head 168 of a typical pilot who might be associated with aircraft of the type shown.

Figure 5A:
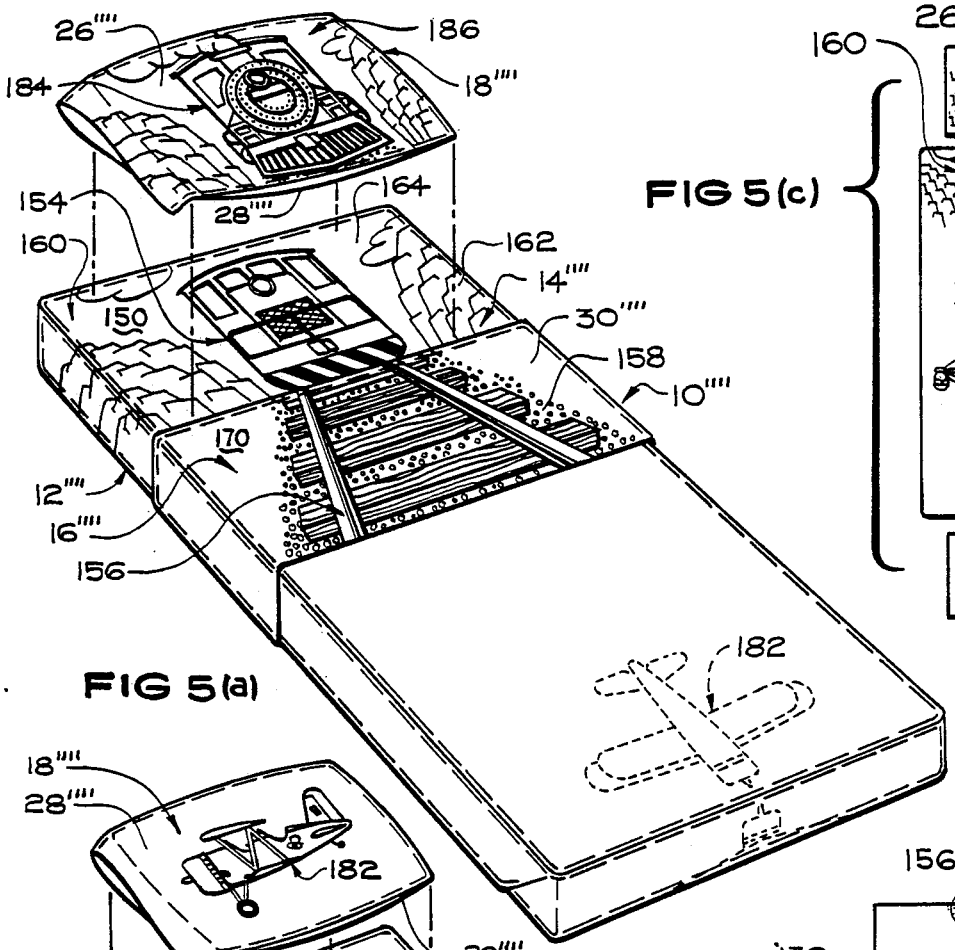
FIG. 5*a* is an elevated perspective view of a mattress or similar portion of a bed having yet another embodiment of the bed clothes of the present invention in operative association therewith.

The upper bed clothes element 16'''', like the lower bed clothes element 14'''', comprises longitudinally spaced apart end portions 170 and 172 which are printed or otherwise depict subject matter corresponding with the two hobbies discussed above. In particular, the end portion 170 of the element 14'''' is printed with a perspective view of the same railroad tracks 156 and roadbed 158 as are on the element 16'''', and the end portion 172 of the element 16'''' is printed with the top and bottom views of the same or a similar aircraft 166 as is depicted on the element 16''''. The railroad tracks 156 on the element 16'''' will be seen as extending from the edge 174 of the element 16'''' to an imaginary point 176 of infinity as is typical in a perspective view, with the tracks 156 extending generally centrally and longitudinally of the element 16'''' and across the fold line 178 along which the end portion 30'''' of the element 16'''' is typically folded back upon itself, as shown in FIG. 5a. With this arrangement, when the end portions 150 and 170 of the bed clothes elements 14'''' and 16'''' are arranged adjacent the head of the bed 12'''', the tracks 156 on the element 16'''' are pictorially aligned with the engine 154 and scenic background 160 on the end portion 150 of the lower bed clothes element 14'''' so that the composite pictorial illustration is provided of the engine 154 traveling through the background 160 and along the tracks 156.

Figure 5B:
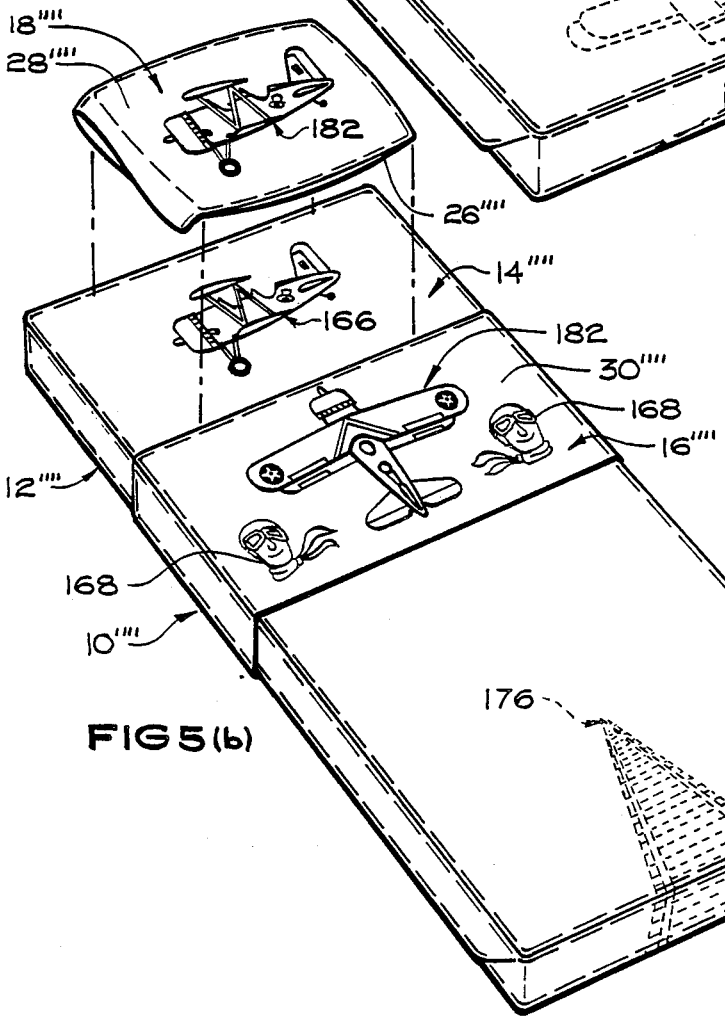
FIG. 5*b* is a view similar to FIG. 5*a* with the bed clothes turned end for end from the position shown in FIG. 5*a* and the pillow and associated pillowcase turned over from the position shown in FIG. 5*a;*
Figure 5C:
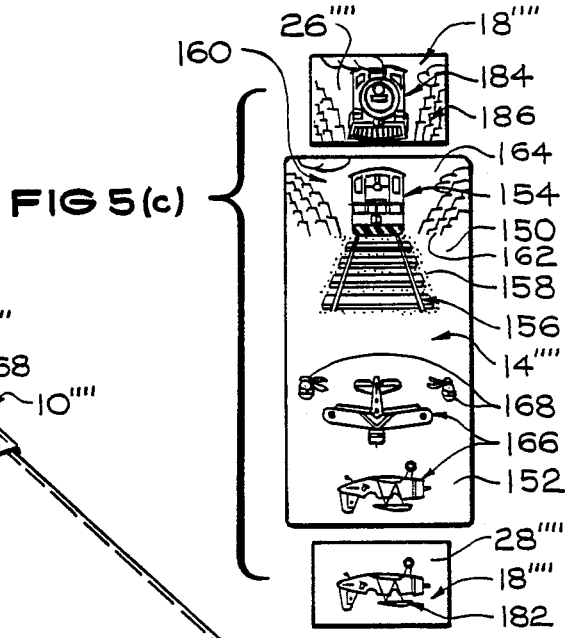
FIG. 5*c* is a plan view of the bottom bed clothes element depicted in FIGS. 5*a* and 5*b*, as shown in operative association with the upper and lower sides of the pillowcase shown in FIGS. 5*a* and 5*b*.
Figure 5D:
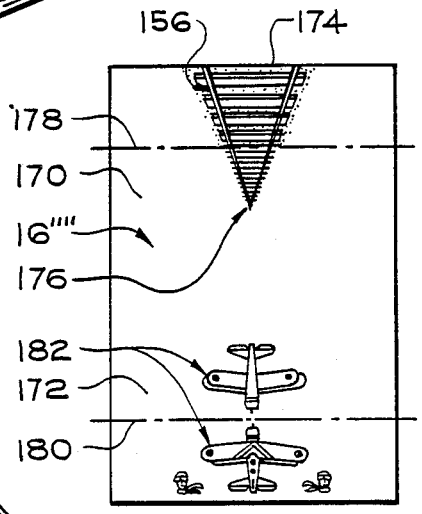
FIG. 5*d* is a plan view of the upper bed clothes element (sheet) depicted in FIGS. 5*a* and 5*b*.

The items 166 and 168 on the upper bed clothes element 16'''', while not intended to form a composite pictorial illustration with the aircraft views on the end portion 152 of the lower bed clothes element 14'''', are intended to be arranged generally adjacent thereto when the end portion 172 is folded along the line 180, as best seen in FIG. 5b, with the result that the same general hobby subject matter can be viewed or perceived as a group or whole when the elements 14'''' and 16'''' are oriented adjacent the head of the bed 12'''', as shown in FIG. 5b.

With reference to the pillowcase 18'''', the sides 26'''' and 28'''' thereof are printed so as to correspond with the end portions 150, 170 and 152, 172, respectively, of the bed clothes elements 14'''' and 16'''' in much the same manner as hereinabove described. In particular, the side 28'''' of the pillowcase 18'''' is depicted with a side view of an aircraft 182, which may be the same, related or different from the aircraft 166 on the elements 14'''' and 16'''' so that when the pillowcase 18'''' and associated pillow are oriented in the manner shown in FIG. 5b, the same or common subject matter appears on the end portions 152 and 172 of the bed clothes elements 14'''' and 16'''' and on the side 28'''' of the pillowcase 18'''' so that a common idea or thought is presented thereby.

The side 26'''' of the pillowcase 18'''', on the other hand, is depicted with a railroad engine 184 which may be the same or different from that depicted on the bed clothes element 14'''', and by way of illustration, the engine 184 is of the steam engine type and as such, is different from the engine 154. More particularly, the engine 184 is shown in operative association with a scenic background 186 which may be the same or different from the above-described scenic background 160, but in the example hereof, is generally the same as the background 160. The size of the engine 184 is of the same general proportions (scale) as the engine 154 whereby, when the pillowcase 18'''' and associated pillow are positioned as shown in FIG. 5a, the scene depicted on the side 26'''' of the pillowcase 18'''' provides a composite pictorial illustration with the folded back end portion 30'''' of the upper bed clothes element 16'''' by virtue of the fact that engine 184 appears to be traversing the railroad tracks 156 and roadbed 158 depicted on the folded back end portion 30''''. It is to be noted that a certain degree of animation or change in condition occurs between the scene on the side 26'''' of element 18'''' and end portion 150 of the sheet 14'''' by virtue of the fact that the steam from the engine 184 becomes the clouds in the background 160.

It will be appreciated, of course, that the railroad and aircraft hobbies depicted on the bed clothes elements 14'''', 16'''' and 18'''' are merely shown by way of example and the various other related or different subject matters may be employed thereon without departing from the present invention. Other typical examples could be a race car on the pillowcase 18'''' shown driving along a portion of a roadway or race course depicted on the elements 14'''' and 16'''', or an airplane on the pillowcase 18'''' landing on a runway depicted on the elements 14'''', 16'''', a bobsled traversing a hill, and athletic events or activities, etc. Further, it will be appreciated that the scenic backgrounds shown and described in connection with FIGS. 5a–5d have been elected merely for the purpose of illustrating the invention hereof and that various other scenic backgrounds can be utilized, including backgrounds wherein a change of scenes occur, such as changes in the time of year, i.e., spring flowers and autumn falling leaves, etc.

As previously described, the bed clothes elements 14'''' and 16'''' are intended to be selectively end-for-end positioned upon the associated bed 12'''' in either of the two positions shown in FIGS. 5a and 5b, with the pillowcase 18'''' being appropriately oriented to provide the desired visual appearance, whereby the set of bed clothes elements 14'''', 16'''' and 18'''' provides two completely different, or in the illustrated embodiment, different but related, themes, designs or patterns. It is to be noted that for certain applications, it may be desirable to only reverse one of the elements 14'''', 16'''' so that variations in appearance can be achieved such as aircraft flying over railroad tracks, trains traveling under planes in flight, etc.

It will be seen from the foregoing that the present invention provides a novel bed clothes construction that will find wide and universal application by virtue of the fact that any combination of patterns, designs, graphics, articles, objects, persons, characters, animals, scenes or scenic backgrounds may be provided on the opposite ends of the upper and lower bed clothes elements and on the opposite sides of the associated pillowcase, whereby the elements may be selectively positioned upon the associated bed to provide any one of a variety of different visual impressions. By virtue of the fact that the pattern, design, object, article, scenic background, etc., at one end of the bed clothes is hidden from view when the bed is made up, the visual impression is given that the bed clothes elements are printed or otherwise depict solely the pattern, design, object, etc., at the head of the bed, with the result that the entire set of bed clothes can give at least two different visual impressions, yet the observer of the bed clothes will only be able to perceive one of the visual impressions at a time and if he is not otherwise aware of the fact that the bed clothes have a different or related pattern, design, article, object, etc., printed at the foot end of the bed and on the reverse side of the pillowcase, such observer would undoubtably be of the impression that two or more sets of bed clothes would be required to provide the different visual impressions. It will also be appreciated that the various articles, objects, characters, animals, scenes or scenic backgrounds may undergo any desired transition between associated bed clothes elements so as to create different degrees of change or animation which, in the case of characters, may comprise a change of condition, such as a change of attire and/or a change in position. It will be noted, of course, that the present invention is not intended to be limited to any particular size, shape or relative position of the article, object, pattern, etc., depicted on the bed clothes elements, since the size of the article, pattern, character, etc., may range from relatively small objects to objects of virtual human size proportions. Moreover, the present invention is not intended to be limited to any specific or single colors, since multiple colors, blends or combinations of colors, including plain colors, may be readily utilized in the present invention. Also, the present invention is not intended to be limited to applications wherein both the upper and lower bed clothes elements are necessarily reversible in order to provide the desired change in pattern, appearance, condition, etc., since it is contemplated that one or the other of the upper or lower bed clothes elements 14, 16 may be changed without end-for-end reversing the other element and/or reversing the associated side of the pillowcase which faces up and cooperates with said upper and lower bed clothes elements.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. In combination with a bed or similar type of apparatus having a covering element disposed thereupon and a head portion at one end thereof and a foot portion at the opposite end thereof, and adapted to have a pillow-like device placed at the head portion thereof, a bed sheet adapted to overlie said bed and be arranged at least in part beneath said covering element and comprising first and second areas adapted to be selectively alternately oriented adjacent the head and foot portions of the bed, said sheet having said first area printed with a first graphic illustration depicting a first subject matter and a second area printed with a second graphic illustration depicting a second subject matter, different from the first subject matter, whereby when said sheet is disposed on the bed with said second area adjacent said head portion and the covering element disposed in overlying relation with respect to said first area so that only said second area of said bed sheet is exposed, the visual impression is given that said bed sheet depicts solely said second subject matter, and when said bed sheet is disposed on the bed with said first area adjacent said head portion and the covering element disposed in overlying relation with respect to said second area so that only said first area of said bed sheet is exposed, the visual impression is given that said bed sheet depicts solely said first subject matter, and a pillowcase element having first and second sides and adapted to receive the pillow-like device therewithin, said first side having means depicting a subject matter which cooperates with said first subject matter depicted on said first area of said bed sheet, and said second side having means depicting a second different subject matter which cooperates with said second subject matter depicted on said second area of said bed sheet.

2. The invention as set forth in claim 1 wherein said bed sheet is generally rectangular-shaped and comprises major and minor axes, with the first and second areas being located adjacent the opposite ends of said major axis.

3. The invention as set forth in claim 1 wherein said bed sheet comprises a bottom bed sheet.

4. The invention as set forth in claim 1 wherein said bed sheet comprises a top bed sheet.

5. The invention as set forth in claim 1 wherein one of said subject matters on said bed sheet comprises a scenic background.

6. The invention as set forth in claim 1 wherein the subject matters on one of said sides of said pillowcase and on one of said areas of said bed sheet cooperate to depict a composite pictorial illustration of a predetermined total object.

7. The invention as set forth in claim 6 wherein the subject matter on one side of said pillowcase and on one of said areas on said bed sheet cooperate to depict a first composite pictorial illustration, and wherein the subject matter on the opposite side of said pillowcase and the other area of said bed sheet cooperate to depict a second composite pictorial illustration.

8. The invention as set forth in claim 6 wherein said composite pictorial illustration is comprised at least in part of a plurality of smaller objects.

9. The invention as set forth in claim 6 wherein said composite pictorial illustration depicts a hobby-like theme.

10. The invention as set forth in claim 9 wherein said first and second subject matters depicted on said sheet comprise related, but different themes.

11. The invention as set forth in claim 6 wherein said composite pictorial illustration is of a character of human-like form comprising a head, torso, and arms and legs.

12. The invention as set forth in claim 11 wherein the head of said character comprises the subject matter depicted on one side of said pillowcase, and the torso, arms and legs comprise the subject matter depicted on one of said areas of said bed sheet.

13. In combination, a bed sheet having one end printed with a graphic illustration depicting a first predetermined subject matter, and the other end thereof printed with a graphic illustration depicting a second predetermined subject matter different from the first subject matter, and a pillowcase having first and second sides and adapted to have a pillow-like device disposed interiorly thereof, said first and second sides being printed with subject matters different from one another and graphically coordinating with the predetermined subject matters on said one and said other ends, respectively, of said bed sheet, whereby when the bed sheet is placed upon a bed or similar area of repose with said one end thereof arranged adjacent the head of the bed and an associated bed clothes covering said other end thereof, and when said pillow case is arranged with said first side thereof facing upwardly, the visual impression is given that the entire bed sheet and said pillowcase has one graphically coordinated subject matter printed thereon, and when the bed sheet is placed upon said bed with said other end thereof arranged adjacent the head of the bed and said associated bed clothes covering said one end thereof, and with the pillowcase turned upside down so that said second side thereof is facing upwardly, the visual impression is given that the entire bed sheet and said pillowcase has another graphically coordinated subject matter printed thereon.

14. The invention as set forth in claim 13 wherein said bed sheet is generally rectangular-shaped and comprises major and minor axes, with the one and other ends thereof being located adjacent the opposite ends of said major axis.

15. The invention as set forth in claim 13 wherein said bed sheet comprises a top bed sheet.

16. The invention as set forth in claim 13 wherein said bed sheet comprises a bottom bed sheet.

17. The invention as set forth in claim 13 wherein the subject matter on one of said sides of said pillowcase and one of the ends of said bed sheet graphically coordinate to depict a composite pictorial illustration of a total object.

18. The invention as set forth in claim 17 wherein the subject matter on one side of said pillowcase and on one end of said bed sheet graphically coordinate to depict a first composite pictorial illustration, and wherein the subject matter on the other end of said bed sheet and the other side of said pillowcase element graphically coordinate to depict a second composite pictorial illustration.

19. The invention as set forth in claim 18 wherein one of said composite pictorial illustrations comprises a hobby-like theme.

20. The invention as set forth in claim 13 wherein a common, but different theme is depicted at said one and said other ends of said bed sheet.

21. The invention as set forth in claim 17 wherein said composite pictorial illustration is of a character of human-like form comprising a head, torso, and arms and legs.

22. The invention as set forth in claim 21 wherein the subject matter on one side of said pillowcase comprises the head of said character, and wherein the subject matter on one of said ends of said sheet comprises the torso, arms and legs.

23. The invention as set forth in claim 21 wherein the character is depicted in different degrees of attire on said pillowcase and on said bed sheet.

24. A set of bed clothes elements consisting of upper and lower bed sheets, with each of said sheets having first and second end portions, said first end portions of said sheets being printed with a first graphic illustration depicting a first subject matter, said second end portions of said sheets being printed with a second graphic illustration depicting a second subject matter different from said first subject matter, said set of bed clothes further comprising a pillowcase having first and second sides and adapted to receive a pillow-like device therewithin, said first side being printed with a subject matter graphically coordinating with the subject matter on said first end portions of said bed sheets and said second side being printed with a subject matter different from the subject matter on the first side of said pillowcase and graphically coordinating with the subject matter on said second end portions of said bed sheets, said sheets adapted to be placed upon an associated bed with either the first or second end portions thereof selectively disposed adjacent the head of the bed and the opposite end portions thereof disposed adjacent the foot of the bed, and when said pillowcase is disposed in its normal operative position adjacent the head of the bed with said first side of said pillowcase facing upwardly and the subject matter on the sheets arranged at the foot end of the bed and on the underside of said pillowcase being concealed, the sheets and pillowcase appear to depict solely the subject matter on the first end portions of the sheets arranged at the head of the bed and the subject matter on the then first upwardly facing side of the pillowcase, and when the bed sheets are changed end for end and the pillowcase is inverted, the sheets and pillowcase appear to depict solely the subject matter on the second end portions of the sheets and on the then second upwardly facing side of said pillowcase.

25. The invention as set forth in claim 24 wherein said bed sheets are of a size adapted to be placed upon at least a double bed size bed, and which includes a pair of pillowcases each of which is adapted to receive a pillow-like device therein.

26. The invention as set forth in claim 25 wherein said means on one side of said pillowcases and said means on one of said ends of one of said bed clothes elements graphically coordinate to depict a composite pictorial illustration of a predetermined total object.

27. The invention as set forth in claim 26 wherein said composite pictorial illustration is formed with at least one of said sheets and both of said pillowcases.

28. The invention as set forth in claim 26 wherein said composite pictorial illustration is of a character of human-like form comprising a head, torso, and arms and legs.

29. The invention as set forth in claim 28 wherein the head of said character is depicted on said one pillowcase and the torso, arms and legs are depicted on said one of the bed sheets.

* * * * *